US005490625A

United States Patent [19]

Myatt

[11] Patent Number: 5,490,625

[45] Date of Patent: Feb. 13, 1996

[54] PAPER TOWEL AND TOILET PAPER PORTABLE DISPENSER

[76] Inventor: Patricia A. Myatt, 191 Willoughby St., Apt. 4-A, Brooklyn, N.Y. 11201

[21] Appl. No.: 230,720

[22] Filed: Apr. 21, 1994

[51] Int. Cl.[6] ..... B26F 3/02

[52] U.S. Cl. ..... 225/47; 225/66; 225/78; 242/596.4; 242/596.7; 242/598.6

[58] Field of Search ..... 225/39, 43, 45, 225/46, 47, 65, 77, 66, 78; 242/596, 596.4, 596.7, 596.8, 598.6, 599.3

[56] References Cited

U.S. PATENT DOCUMENTS

| | | | |
|---|---|---|---|
| D. 201,298 | 6/1965 | Bahnsen | D52/2 |
| D. 216,740 | 3/1970 | Bye | D52/2 |
| D. 223,049 | 3/1972 | Brooks | D52/2 |
| D. 235,832 | 7/1975 | Douglas | D6/96 |
| D. 247,465 | 3/1978 | Ford | D6/97 |
| 851,835 | 4/1907 | Ramsey | 225/42 |
| 1,029,490 | 6/1912 | Connors et al. | 225/43 |
| 2,978,156 | 4/1961 | Yaniello | 225/42 |
| 3,184,053 | 5/1965 | Eldridge | 242/598.6 X |
| 3,228,579 | 1/1966 | Dong et al. | 225/47 X |
| 5,172,966 | 12/1992 | Myatt | 312/34.8 |

*Primary Examiner*—Richard K. Seidel
*Assistant Examiner*—Raymond D. Woods
*Attorney, Agent, or Firm*—Richard L. Miller

[57] ABSTRACT

An improved paper towel and toilet paper portable dispenser is provided, which consists of a housing having a cylindrical body, a pair of end walls and a longitudinal flap between the end walls, to provide an opening in the cylindrical body of the housing. Components are for rotatively retaining a roll of paper toweling/toilet tissues within the cylindrical body of the housing between the pair of end walls, so that a free portion of the roll can extend through the opening in the cylindrical body of the housing. A serrated cutting blade is along an edge of the opening in the cylindrical body of the housing for tearing off the free portion of the roll, so that a person can utilize the free portion. A strap is affixed to one of the retaining components for carrying the dispenser.

6 Claims, 1 Drawing Sheet

Fig. 1
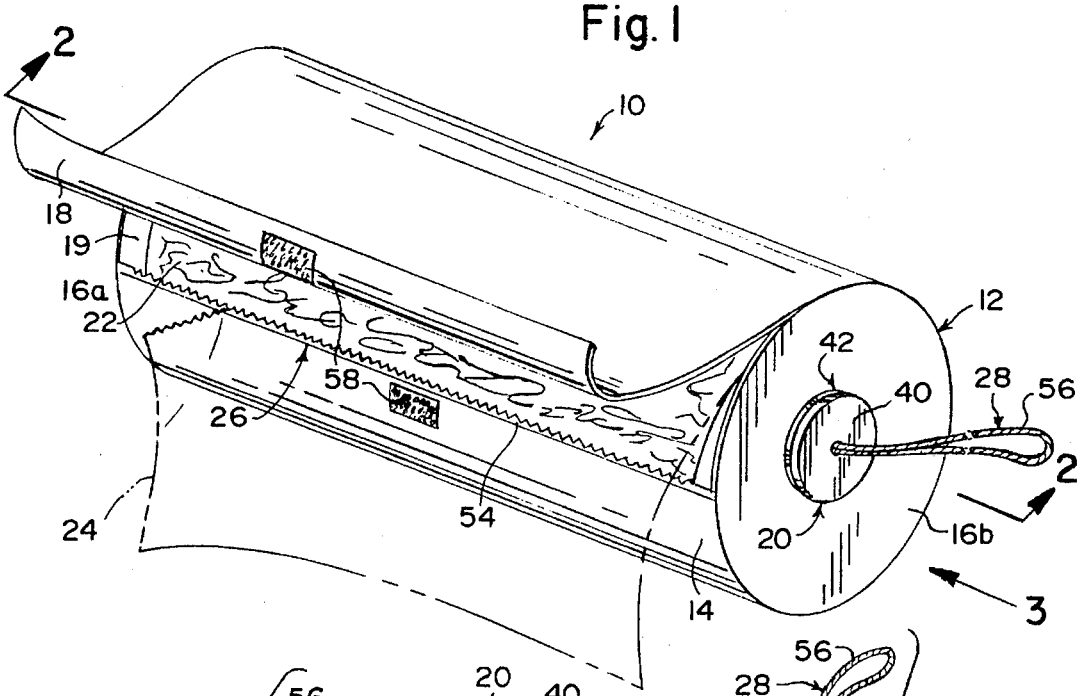
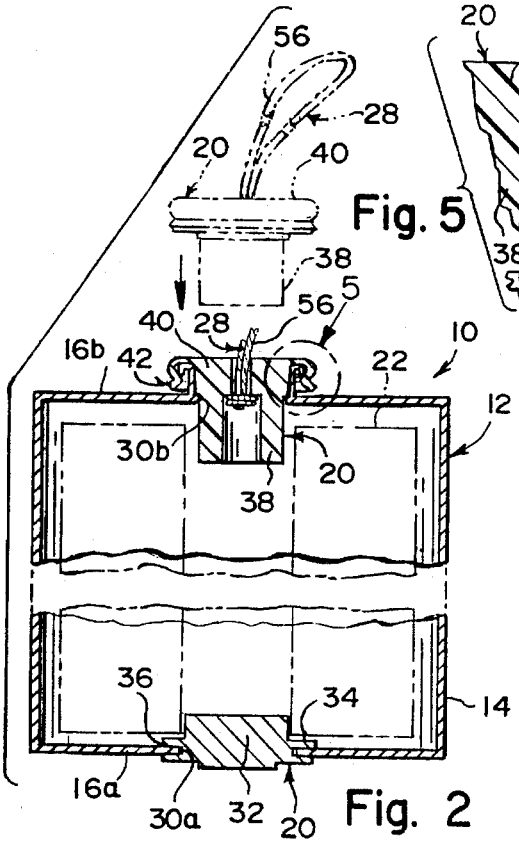
Fig. 2
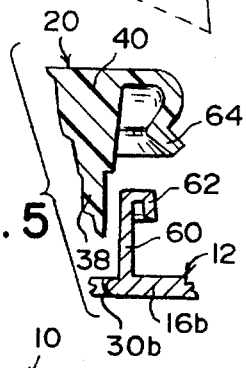
Fig. 5
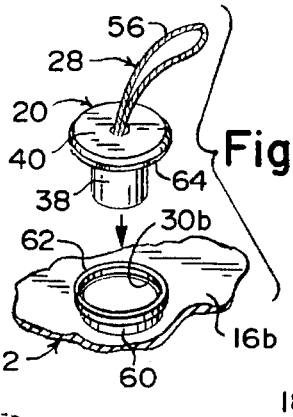
Fig. 4
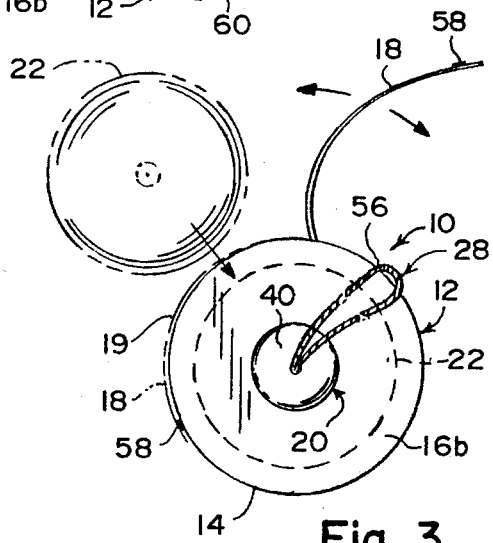
Fig. 3

PAPER TOWEL AND TOILET PAPER PORTABLE DISPENSER

BACKGROUND OF THE INVENTION

The instant invention relates generally to toilet paper and paper towel holders and more specifically it relates to an improved paper towel and toilet paper portable dispenser.

Numerous toilet paper and paper towel holders have been provided in prior art that are adapted to be mounted to flat vertical surfaces or carried by a strap. For example, U.S. Pat. No. 851,835 to Ramsey; U.S. Pat. No. 1,029,490 to Connor; U.S. Pat. No. 2,978,156 to Yaniello; U.S. Pat. No. 5,172,966 to Myatt; Des. 201,298 to Bahnsen; Des. 216,740 to Bye; Des. 223,049 to Brooks; Des. 235,932 to Douglas and Des, 247,465 to Ford all are illustrative of such prior art.

While these units may be suitable for the particular purpose to which they address, they would not be as suitable for the purposes of the present invention as heretofore described.

SUMMARY OF THE INVENTION

A primary object of the present invention is to provide an improved paper towel and toilet paper portable dispenser that will overcome the shortcomings of the prior art devices.

Another object is to provide an improved paper towel and toilet paper portable dispenser, which will protect and cover a paper towel or toilet paper roll, so as not to become dirty when being transported.

An additional object is to provide and improved paper towel and toilet paper portable dispenser that includes a roll centering stub shaft securement mechanism that can be quickly installed thereto.

A further object is to provide an improved paper towel and toilet paper portable dispenser that is simple and easy to use.

A still further object is to provide an improved paper towel and toilet paper portable dispenser that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures one, he drawings are briefly described as follows:

FIG. 1 is a perspective view of the instant invention with the flap open and illustrating paper being torn off in phantom;

FIG. 2 is an enlarged cross sectional view with parts broken away taken on line 2—2 of FIG. 1;

FIG. 3 is an end view taken in the direction of arrow 3 in FIG. 1;

FIG. 4 is a perspective view with parts broken away showing the second stub shaft ready to be inserted; and FIG. 5 is an enlarged diagrammatic cross sectional view with parts broken away showing the area indicated by arrow 5 in FIG. 2 in greater detail.

DETAILED DESCRIPTION OF THE PREFERRED EMBODIMENTS

Turning now descriptively to the drawings, in which similar reference characters denote similar elements throughout the several views, FIGS. 1 through 3 illustrate an improved paper towel and toilet paper portable dispenser 10, which consists of a housing 12 having a cylindrical body 14, a pair of end walls 16*a*, 16*b* and a longitudinal flap 18 between the end walls 16*a*, 16*b* to provide an opening 19 in the cylindrical body 14 of the housing 12. Components 20 are for rotatively retaining a roll 22 of paper toweling/toilet tissues within the cylindrical body 14 of the housing 12 between the pair of end walls 16*a*, 16*b*, so that a free portion 24 of the roll 22 can extend through the opening 19 in the cylindrical body 14 of the housing 12. A structure 26 is along an edge of the opening 19 in the cylindrical body 14 of the housing 12, for tearing off the free portion 24 of the roll 22, so that a person can utilize the free portion 24. An element 28 is affixed to one of the components 20 for carrying the dispenser 10.

The retaining components 20 include the end walls 16*a*, 16*b* of the housing having aligned apertures 30*a*, 30*b* therethrough. A first stub shaft 32 has an enlarged flange 34, with an annular edge groove 36. The annular edge groove 36 in the enlarged flange 34 will engage with the first aperture 30*a* in the first end wall 16*a*, with the first stub shaft 32 extending into the cylindrical body 14. A second stub shaft 38 has an end cap 40. A mechanism 42 is for retaining the end cap 40 in a removable manner over the second aperture 30*b*, so that the second stub shaft 38 will extend into the cylindrical body 14.

The tearing structure 26 is a serrated cutting blade 54. The carry element 28 is a strap 56 extending through the end cap 40, so that a person can grip the strap 56 and carry the dispenser 10 therefrom. The dispenser 10 also contains mating hook and loop pile fastener material tabs 58 on the flap 18 and the cylindrical body 14, so as to hold in a releasable manner, the flap 18 to the cylindrical body 14 of the housing 12.

The retaining mechanism 42 includes a first collar 60 on the second end wall 16*b* about the second aperture 30*b*. A lip 62 is formed about a free edge of the first collar 60. A flexible second collar 64 is formed about the end cap 40 for engagement with the lip 62 on the first collar 60, when the end cap 40 is pressed towards the second end wall 16*b* and the second stub shaft 38 enters the second aperture 30*b*.

The first end wall 16*a* may also contain another second stub shaft 38 with its end cap 40 to substitute for the first stub shaft 32 with its enlarged flange 34 and annular edge groove 36. Another retaining mechanism 42 identical to the one on the second end wall 16*b* will also be in place. The strap 56 could be eliminated from the second end cap 40. In other words it is to be noted that while not specifically illustrated the instant invention may alternatively have both stub shafts be of the type which are removable, as indicated by numeral 38, at each end of the device instead of having a first stub shaft be of the fixed type, as is indicated by numeral 32, and that this is merely a matter of design choice and well within the scope of the invention.

OPERATION OF THE INVENTION

To use the dispenser 10, a person simply opens the flap 18 pulls out a free portion 24 of the roll 22 and tears it along the serrated cutting blade 54. The flap 18 can be reclosed with the mating hook and loop pile fastener material tabs 58. The dispenser 10 is carried by the strap 56. To replace the roll 22, the flexible second collar 64 is released from the lip 62 on the first collar 60. The end cap 40 can be removed by pulling the strap 56, so that the second stub shaft 38 will exit from the second aperture **30*b*. The old roll 22 can then be removed through the opening 19 and a new roll 22 inserted with the end cap 40** replaced.

Depending on the particular design choice for the length of the improved paper towel and toilet paper portable dispenser 10, the device can be used for either paper towel and toilet paper.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved paper towel and toilet paper portable dispenser, comprising:

a) a hollow cylindrical housing having a housing first end and a housing second end and containing a housing longitudinally disposed slot extending from said housing first end to said housing second end so that a roll of the paper towel/toilet paper can be removably inserted into said hollow cylindrical housing and a free portion of the roll is extendable through said housing longitudinally disposed slot;

b) a housing first end wall disposed at said housing first end and containing a centrally disposed housing first end wall aperture with a housing first end wall aperture circumferencial edge, said centrally disposed housing first end wall aperture having a diameter less than that of said first end wall;

c) a housing second end wall disposed at said housing second end and containing a centrally disposed housing second end wall aperture with a housing second end wall aperture circumferencial edge, said centrally disposed housing second end wall aperture having a diameter less than that of said second end wall and being in alignment with said centrally disposed housing first end wall aperture, said cylindrical housing, said housing first end wall, and said housing second end wall defining a housing chamber;

d) a housing longitudinal flap covering said housing longitudinally disposed slot and extending from said first end wall to said second end wall so that the roll of paper towel/toilet paper contained in said housing chamber is protected;

e) a stub shaft having a stub shaft body with a stub shaft flange extending radially outwardly therefrom, said stub shaft flange having a stub shaft flange circumferencial edge containing a circumferencially disposed annular groove, said stub shaft being removably mounted in said centrally disposed housing first end wall aperture with said circumferencially disposed annular groove receiving said housing first end wall aperture circumferencial edge, said stub shaft body extending into said housing chamber and rotatively retaining one end of the roll of the paper towel/toilet paper;

f) a collar extending longitudinally outwardly from said housing second end wall aperture circumferencial edge and having a collar free end;

g) a collar flange extending radially outwardly from said collar free end and having a collar flange open lower edge;

h) an end cap being removably mounted in said collar and having an end cap lower end and an end cap upper end; and i) an end cap flange extending radially outwardly from said end cap upper end and having an end cap flange open lower edge so that when said end cap is inserted into said collar said end cap flange open lower edge receives said collar flange in a releasable manner with said end cap lower end extending into said housing chamber and rotatively retaining another end of the roll of the paper towel/toilet paper.

2. The dispenser as defined in claim 1; further comprising tearing means disposed on an edge of said housing longitudinally disposed slot.

3. The dispenser as defined in claim 2, wherein said tearing means includes a serrated cutting blade so that the free portion of the roll can be removed.

4. The dispenser as defined in claim 3; further comprising carry means extending through said end cap.

5. The dispenser as defined in claim 4, wherein said carrying means is a strap so that a user can grip said strap and carry said dispenser.

6. The dispenser as defined in claim 5; further comprising hook and loop fasteners disposed on said housing longitudinal flap and said hollow cylindrical housing so that said housing longitudinal flap is releasably held to said hollow cylindrical housing.

* * * * *